US005259884A

United States Patent [19]

Schapira et al.

[11] Patent Number: 5,259,884

[45] Date of Patent: Nov. 9, 1993

[54] PROCESS ADAPTED TO PROVIDE ON A METALLIC SUBSTRATE A PROTECTIVE COATING BASED ON HEXAVALENT CHROMIUM, BATH USED IN THE SAID PROCESS AND COMMERCIAL FORM OF THE COMPONENTS OF THE BATH

[75] Inventors: Joseph Schapira, Paris; Patrick Droniou, Colombes; Patrice Pelletier, Lambesc; Daniel Bernard, Epinay S/Seine, all of France

[73] Assignee: Compagnie Francaise de Produits Industriels, France

[21] Appl. No.: 609,619

[22] Filed: Nov. 6, 1990

[30] Foreign Application Priority Data

Nov. 6, 1989 [FR] France ..... 89 14526

[51] Int. Cl.[5] ..... C23C 22/26

[52] U.S. Cl. ..... 148/248; 148/267

[58] Field of Search ..... 148/248, 264, 267

[56] References Cited

U.S. PATENT DOCUMENTS

| | | | |
|---|---|---|---|
| 2,762,732 | 9/1956 | Somers | 148/248 |
| 3,719,534 | 3/1973 | Vessey et al. | 148/248 |
| 3,755,003 | 8/1973 | Palm et al. | 148/248 |
| 3,779,815 | 12/1973 | Hamilton et al. | 148/267 |
| 3,907,608 | 9/1975 | Barrett et al. | 148/248 |
| 3,954,510 | 5/1976 | Gunn et al. | 148/267 |
| 4,644,029 | 2/1987 | Cable et al. | 148/267 |
| 4,931,074 | 6/1990 | Marguier | 148/248 |

FOREIGN PATENT DOCUMENTS

| | | |
|---|---|---|
| 2008770 | 1/1970 | France . |
| 2149434 | 3/1973 | France . |
| 2181068 | 11/1973 | France . |
| 2311074 | 12/1976 | France . |

*Primary Examiner*—Jay H. Woo
*Assistant Examiner*—James P. Mackey
*Attorney, Agent, or Firm*—Larson and Taylor

[57] ABSTRACT

Process comprising a step for the preparation of the metallic substrate by degreasing, possibly followed by mechanical or chemical pickling, a step comprising the use by immersion or spraying of a bath adapted to provide on the metallic substrate the contemplated protective coating and a curing step at high temperature, and characterized by the fact that the above-mentioned bath comprises at least:

a metal in the form of particles, chromic acid and/or one of its derivatives as oxidizing agent, at least one hydrosoluble solvent having a high boiling point and selected from those of the aprotic polar type and of the ketonic type, water.

8 Claims, 3 Drawing Sheets

PROCESS ADAPTED TO PROVIDE ON A METALLIC SUBSTRATE A PROTECTIVE COATING BASED ON HEXAVALENT CHROMIUM, BATH USED IN THE SAID PROCESS AND COMMERCIAL FORM OF THE COMPONENTS OF THE BATH

BACKGROUND OF THE INVENTION

The invention relates to a process adapted to provide on a metallic substrate a protective coating based on hexavalent chromium; it also relates, as novel industrial products, to the bath used in the said process and to the commercial form or presentation of the components of the bath.

Metallic substrates which are intended to be protected against corrosion by use of the above-mentioned process, consist especially of metallic parts of small dimensions and of screwed devices for example of steel or cast-iron.

It is already known (see for example the French Patent FR-A- 2,008,770) to fight efficiently, and without subsequent superficial protection, against corrosion of metallic substrates when providing the said substrates with coatings generally obtained using baths comprising a metal in powder form, especially zinc, chromic acid in solution, an organic solvent comprising, in general, one or several alcohols or polyols as for example the tertiobutanol, the dipropyleneglycol or the diethyleneglycol monoethyl-ether, a wetting agent and water.

The substrate to be protected is subjected to a treatment comprising:

1. a preparation step, i.e. a degreasing step possibly followed by a mechanical or chemical pickling, 2. a step using, by spraying or by immersion, a bath of the type disclosed hereabove, followed by a dripping or a drying and 3. a cooking step of the substrate thus treated at a generally high temperature, for example of about 300° C.

Proceeding thus, one obtains a coating comprising a single layer; in order to obtain a multilayer coating, the said treatment is repeated as often as necessary.

The abovesaid baths present an important drawback consisting in the fact that they are instable.

As a matter of fact, the strong oxydizing character of the chromic acid reduces the life of the bath, the solvents which are used being oxidized, even at normal temperature, after only some days.

Consequently, the quality of the coating obtained decreases quickly with the age of the bath.

The object of the invention is, above all, to overcome the said drawback and to provide a bath of the type in question whose stability is improved and which consequently can be used during a long duration.

DESCRIPTION OF THE INVENTION

Now, Applicants have found, after extensive researches, that surprisingly and unexpectedly it is possible not only to increase in a decisive manner the stability of the baths of the type in question without altering their efficiency, but also to make the said baths more efficient than those of the prior art as far as the resistance against corrosion of the coatings obtained is concerned, when there is used, as organic solvent, a hydrosoluble solvent having a high boiling point of the aprotic polar type and/or of the ketonic type.

Consequently, the process according to the invention, which is adapted to provide on a metallic substrate, a protective coating against corrosion based on hexavalent chromium, the said coating being such that no supplementary protection is necessary, and which comprises:

a step for the preparation of the metallic substrate by degreasing, possibly followed by mechanical or chemical pickling, a step comprising the use by immersion or spraying of a bath adapted to provide on the metallic substrate the contemplated protective coating and a curing step at a higher temperature, is characterized by the fact that the said bath comprises at least:

a metal in the form of particles, chromic acid and/or one of its derivatives as oxydizing agent, at least one hydrosoluble solvent having a high boiling point and selected from those of the aprotic polar type and of the ketonic type, water.

The above-mentioned bath according to the invention comprises advantageously one or several surfactive agents and one or several rheological additives.

That bath is obtained by mixing its components at the moment of its use.

In a commercial form or presentation, the components of the bath are grouped within two or possibly three groups, which are separated from one another and commercialized advantageously under a form or presentation which is denoted in practice by the expression "kit".

When there are two groups, the first one comprises the chromic acid and/or its derivatives in the form of powder or of concentrated solution while the second group comprises, under the form of a dispersion or of a slurry possibly concentrated, the metal in the form of particles, the hydrosoluble organic solvent and possibly one or several surfactive agents and one or several rheological additives, the said first and second group being located respectively in a first and in a second compartment of the kit.

When there are three groups, the third one is consisting of a part or of the totality of the surfactive agents and of the rheological additives, the said third group being located in a third compartment of the kit.

When the above-mentioned first group is in the form of a concentrated solution, the latter comprises advantageously from 1 to 85% by weight of hexavalent chromium ion expressed in chromate.

In the same way, when the second group is in the form of a concentrated slurry, it contains advantageously from 2 to 80% by weight of metallic particles dispersed in one part of the organic solvent, the third group comprising then, within another part of the organic solvent, the surfactive agents and the rheological additives in an amount from 1 to 70% by weight.

The metal in the form of particles can be selected from the metals, alloys or mixtures of metals or alloys which have a normal electrode potential which is negative, the absolute value of the said potential being at least that of the metal to be protected.

In practice, the said metal is selected from the group comprising zinc, iron, aluminum, cadmium, magnesium, manganese and their alloys; zinc, aluminum and their mixtures or alloys are especially preferred.

The size of the metal particles must be compatible with the thickness required for the protective coating.

In general, the said size is from 1 to 25 μm (that latter dimension corresponding to the length of the slates when the metal is lamellar).

Preferably, the bath according to the invention is in the form of an aqueous dispersion of metallic particles comprising from 5 to 40% of metal.

The hexavalent chromium is in the form of chromic acid, its alkaline-metal salts or earth-alkaline metal salts, its salts of metals of transition, its ammonium salt, the chromium anhydride and, more generally, any substance capable to set free ions containing hexavalent chromium; it is present in the bath at a rate of about 0.5 to 15% by weight, expressed in chromate ions.

The hydrosoluble solvent having a high boiling point and which is of the ketonic type and/or of the aprotic polar type is present in the bath in an amount such that the ratio solvent/chromate ion is comprised between 0.5 and 20.

The solvents of the ketonic type used for the constitution of the bath according to the invention comprise those represented by formula I

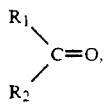

(I)

in which the radicals $R_1$ and $R_2$ represent linear or ramified alkyle groups in $C_1$ to $C_{18}$, identical or different from one another, adapted to form a cycle, as well as certain polyketonic derivatives or certain derivatives of the lactone type; the above-mentioned ketonic derivatives are selected among those which are represented by formula (I), whose solubility in water is at least equal to 5% (W/W), whose flash point is higher or equal to 50° C. and whose boiling point is at least equal to 100° C.

The solvents of the aprotic polar type used in the constitution of the bath according to the invention are preferably consisting of the disubstituted amides of the formula II

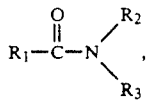

(II)

in which the radicals $R_1$, $R_2$ and $R_3$ represent linear or ramified alkyle groups in $C_1$ to $C_{18}$, identical or different from one another, and adapted to form a cycle.

According to an advantageous embodiment of the bath according to the invention, the hydrosoluble solvent which is a part of the said bath is selected from the group comprising cyclohexanone, hexane-dione-2.5, gammabutyrolactone, dimethyl formamide, dimethyl acetamide, N-methyl-pyrrolidone.

The surfactive agents possibly comprised by the bath used according to the invention can be selected among the non ionic surfactive agents such as the polyethoxy-ethers of alkylphenol, of alcohol or of amine possibly substituted.

The rheological additives possibly comprised by the bath used according to the invention can be selected among the thickening agents such as etherified or esterified celluloses, the derivatives of xanthane, and the thixotropic derivatives of silica, of montmorillonit or of aluminum such as aluminum stearate.

The metallic substrates which can be subjected to the treatment according to the invention are based on steel, on cast-iron and on sintered steel used in devices of the screw-cutting industry, of the bolt manufacture and of small parts; they can also consist of steel strips.

The step during which the substrate is treated using the bath according to the invention can be carried out by immersion followed by dripping, by spraying, by immersion followed by centrifugation in the case of small parts of the screw-cutting industry, or using rolls when treating metal strips.

Once provided with the protective coating which comprises the various components of the bath, the substrate is subjected to a cooking or curing step between 100 and 350° C. during a few minutes, especially during 5 to 45 minutes in order to harden the coating by evaporation of volatile substances.

In function of the use to which the metallic substrate is intended and in function of the thickness requested for the protective coating, the latter can comprise one or several layers. In order to obtain a coating having several layers (multilayer), the above-mentioned treatment cycle is repeated as many times as necessary, the said treatment comprising possibly when treating a substrate of the screw-cutting industry:

an immersion in the bath according to the invention, a dripping or drying, a curing step at a temperature comprised between 120° and 200° C.

A final curing step (at a temperature comprised between 200° and 350° C.) is used in the place of or in complement to the last curing step at a temperature between 120° and 200° C.

The thickness of the coatings obtained according to the invention is generally comprised between 1 and 15 μm.

The substrates subjected to the treatment according to the invention must be clean and adapted to receive the anticorrosion protective coating. According to their degree of dirtiness or smudge, it can be necessary to subject them to a pretreatment comprising an alkaline degreasing step and/or a degreasing step with a solvent, a rinsing step and, if necessary, a mechanical or chemical pickling.

One of the important advantages obtained thanks to the invention lies in the fact that it becomes unnecessary to apply to the coatings once obtained an additional protective layer, for instance of paint.

DESCRIPTION OF PREFERRED EMBODIMENTS

The invention will be well understood thanks to the following non limiting examples in which advantageous embodiments of the invention are disclosed.

EXAMPLE 1

A bath according to the invention is prepared starting from a kit according to the invention which comprises three groups, one of which denoted A is in the form of a slurry containing the metal, another one denoted B comprises a solution containing the chromium ion, the third one denoted C comprising a rheological agent.

Group A consists of 150 g of lamellar zinc (quality ECKA zinc MP 31 129/G commercialized by the Company ECKARTWERKE), 15 g of nonylphenol having 10 ethylene oxide moles (of the trademark CEMULSOL NP 10 commercialized by RHONE-POULENC), 150 g of dimethylformamide and 2 g of hydroxymethyl cellulose.

Group B is consisting of 27.6 g of chromic acid, of 17.4 g of magnesium chromate and of 223 g of water.

Group C which is used to set the viscosity of the final mixture, is consisting of 4 g of hydroxymethyl cellulose in 581 g of water.

These three groups provide, when mixed, 1170 g of a bath ready to be used.

EXAMPLE 2 (Comparative)

A classical formulation is prepared by mixing the solutions $A_1$ and $B_1$ (compositions indicated below), which provides 100 g of a bath ready to be used.

| Components of solution $A_1$ | | Components of solution $B_1$ | |
|---|---|---|---|
| lamellar zinc | 20 g | Water | 51.9 g |
| Dipropylene glycol | 10 g | Chromic Acid | 3 g |
| Ethylglycol acetate | 5 g | Zinc oxide | 1 g |
| White spirit 5% aromat. | 5 g | Boric acid | 1 g |
| REMCOPAL 334 | 1 g | Hydroxyethyl | 0.5 g |
| REMCOPAL 349 | 1.6 g | cellulose | |

The ageing of that bath is compared with the ageing of the bath according to example 1 during a duration of 10 days, the development of the viscosity being observed.

That viscosity, expressed in cps, has been measured in the case of the two baths the 1st, the 2nd, the 3rd, the 4th, the 7th and the 10th day.

Figure 1:
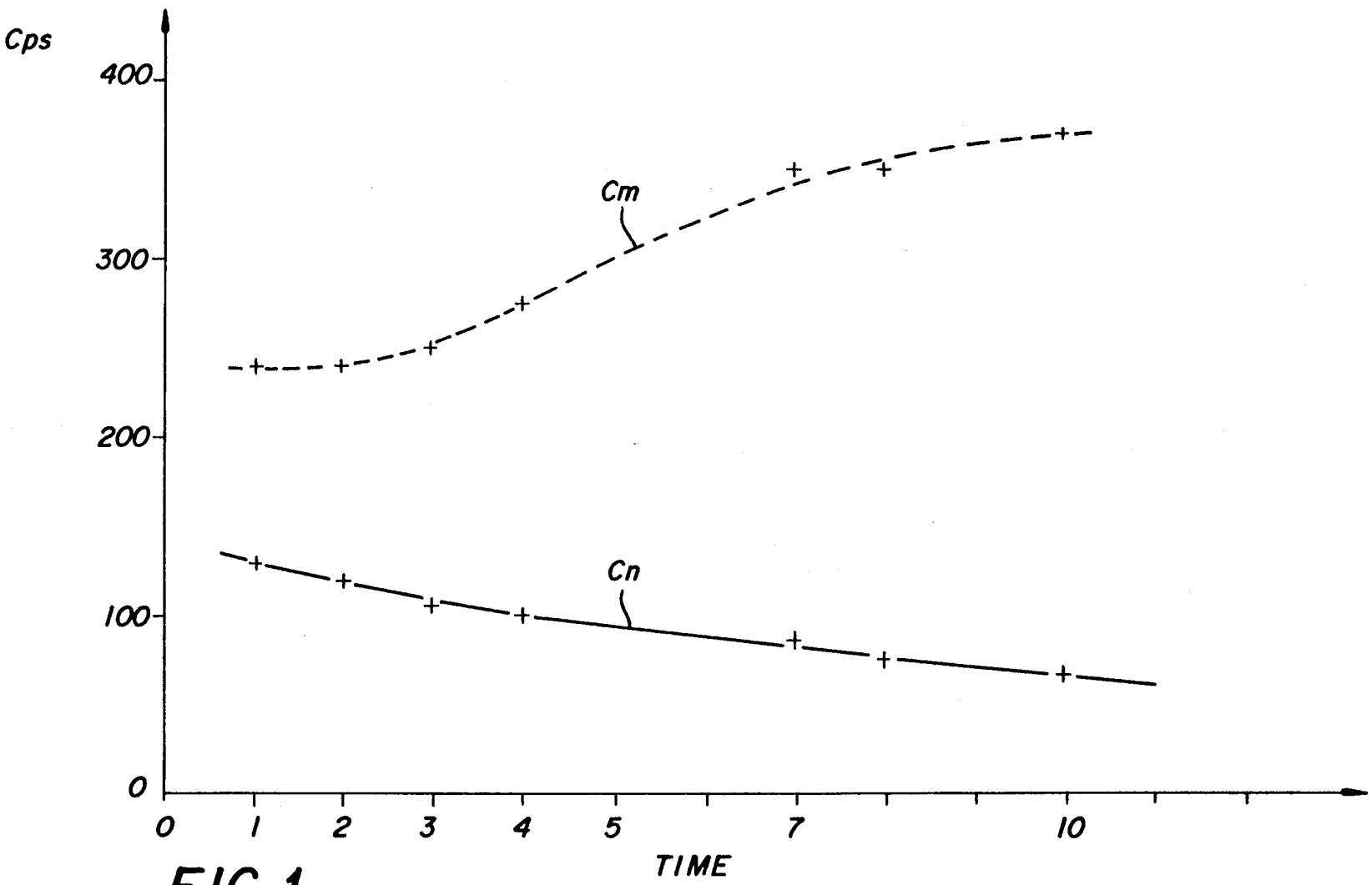
FIG. 1 is a graph showing the change in viscosity over time of the baths of Examples 1 and 2.
Figure 2A:
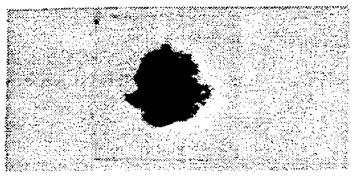
FIGS. 2A "0" through 2A"5" and FIGS. 2B"0" through 2B"5" depict standard marks used to evaluate samples in an adherence test.
Figure 2B:
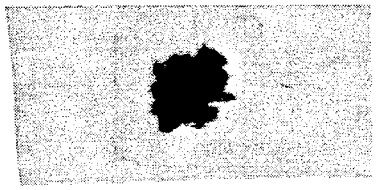
Figure 2C:
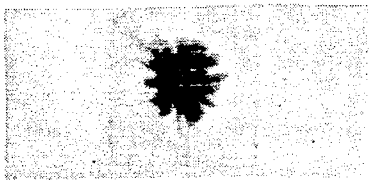
Figure 2D:
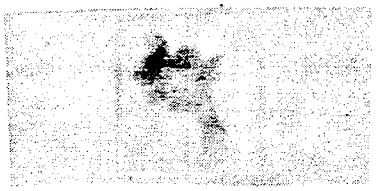
Figure 2E:
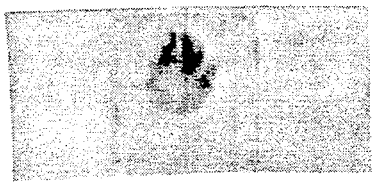
Figure 2F:
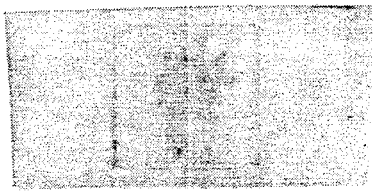
Figure 2G:
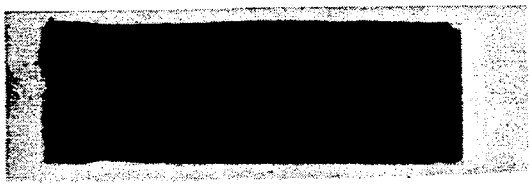
Figure 2H:
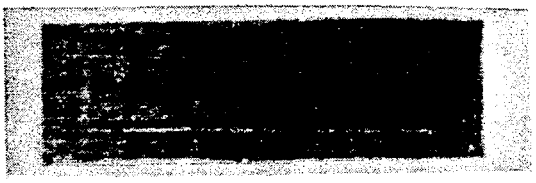
Figure 2I:
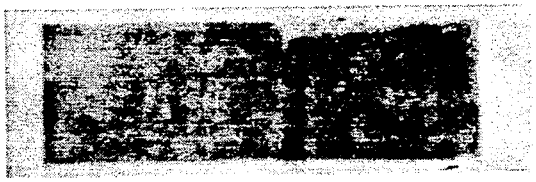
Figure 2J:
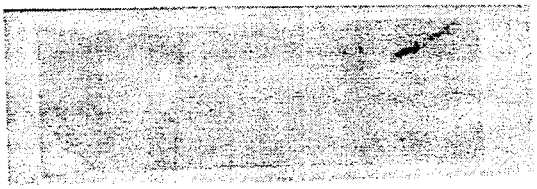
Figure 2K:
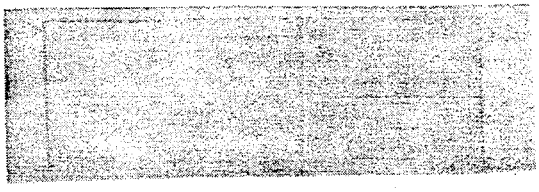
Figure 2L:
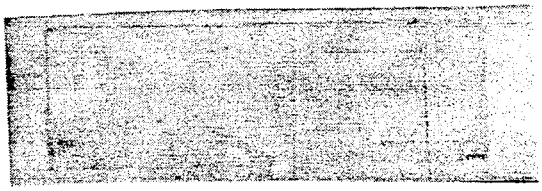

The values measured are plotted on the graph of FIG. 1 which shows the development of the viscosity in cps in function of the duration in days.

There is thus obtained a curve $C_m$ for the bath according to the prior art and a curve $C_n$ for the bath according to the invention.

The examination of FIG. 1 shows that the viscosity of the two baths develops differently: while the quality of the bath according to example 2 decreases progressively due to a gelification, the degradation starting after two days and reaching a maximum of viscosity after about ten days, the bath according to example 1, according to the invention, keeps its fluidity.

These differences in behaviour with respect to ageing bring about differences, as far as the quality of the performances of the obtained coating are concerned, when the coatings are not prepared immediately after the constitution of the bath by mixing of the starting solutions.

In order to show that difference between the performances of the two baths, procedure is as follows.

10 cold-rolled steel sheets having a carbon content equal to 0.02% (10 cm×20 cm) of the quality "ZES" used in the autocar industry are provided with a protective coating using the following steps:

degreasing step using a classical alkaline aqueous composition obtained with the product commercialized under the trademark RIDOLINE 1550 CF/2 by the Applicants and used at a concentration of 15 g/l at 60° C. during 10 minutes, cold rinsing with tap water and drying at 80° C., applying the baths according to examples 1 abd 2, respectively to the half of the above-mentioned 10 sheets, the method used being the so-called method of the calibrated rod (the selected calibrated rod n° 3 can be, for example, that commercialized by the Company RK CHEMICALS Co, with which one obtains a humid film having a thickness of 24 μm), drying during 10 minutes at 120° C., then cooking during 25 to 30 minutes at 300° C.

The dry coating thus obtained has a thickness from about 3.5 to 4 μm.

The thus treated sheets are subjected to adherence tests and to tests of resistance against corrosion, as hereafter explained.

A) Adherence Test

On each sheet there is made a stamp of the type Erichsen [according to the standard PEUGEOT véhicules B 53 3240 (§3.4.3)] whose depth is 8 mm.

On the top of the stamp, one effects a stripping or wrenching with an adhesive tape of reference 250, commercialized by the Company 3 M.

The more superficial is the detachment of the coating, the better is the adherence.

When the detachment is very superficial, the adhesive tape has an appearance which is light grey marked "5".

The mark 5 corresponds to a coating of which no trace has been detached.

When the coating is completely detached, the substrate being visible, that corresponds to mark "0".

The intermediate marks are difficult to be commented and correspond to an appearance which results from the corresponding photographs which are shown on FIG. 2 denoted B"0" to B"5".

When the detachment of the stamp is important, the test is carried out on a plane surface which is not deformed.

The marks corresponding to 0 (totally detached coating, visible substrate) to 5 (no detached trace) result from the appearance of the coating such as it appears on FIG. 2 under A"0" to A"5".

The adherence tests have been carried out using baths whose age is 1, 2, 3, 4, 7 and 10 days corresponding to those used for the measure of the viscosity of the bath.

The marks of each test are recorded in the following Table I.

TABLE I

| Age of the bath (days) | Mark recorded (adherence test) Coating according to example 1 | Coating according to example 2 |
|---|---|---|
| 1 | 4/5 | 3 |
| 2 | 4/5 | 2 |
| 3 | 4/5 | 2 |
| 4 | 4/5 | 2 |
| 7 | 4/5 | 2 |
| 10 | 4/5 | 1 |

It results from the above table that, when using the bath according to example 1, the quality of the adherence remains unchanged, even when the application is carried out 10 days after its preparation; on the contrary, when using the bath according to the comparative example 2, the quality of the adherence is affected already on the second day after the preparation of the bath.

B) Resistance Against Corrosion

In connection with the test of resistance against corrosion, one measures the amount of red rust produced in function of the duration of exposition to salt spray according to standard NF T 41002.

The degree of corrosion (expressed in percentage of corroded surface with respect to the total surface) after an exposition during 168 hours, then during 400 hours to salt spray using the baths of the preceding comparative tests whose ages were 1, 2, 3, 4, 7 and 10 days, has been measured.

The results are recorded in Table II.

TABLE II

| Age of the bath (days) | Bath according to ex. 1 | | Bath according to ex. 2 | |
|---|---|---|---|---|
| | Corrosion (expressed in %) | | | |
| | after 168 h | after 400 h | after 168 h | after 400 h |
| 1 | 0 | from 0 to 5% | 0 | from 20 to 50% |
| 2 | 0 | from 0 to 5% | 0 | from 20 to 50% |
| 3 | 0 | from 0 to 5% | 0 | from 20 to 50% |
| 4 | 0 | from 0 to 5% | 0 | from 20 to 50% |
| 7 | 0 | from 0 to 5% | 0 | from 20 to 50% |
| 10 | <5% | from 0 to 5% | >50% | >50% |

It appears, from the examination of the data recorded in Table II, that the resistance against corrosion is distinctly improved with the bath according to the invention when the baths used for the obtention of the coating have not been prepared just before the test.

Furthermore, the presence of white rust long time before the appearance of red rust has been observed when using the bath according to the comparative example 2. That phenomenon is distinctly diminished and even inexistant when using the bath according to example 1.

EXAMPLE 3

A bath identical to that of example 1 is prepared, using zinc powder, for example the quality ULTRA FINE SPECIALE commercialized by the Company VIEILLE MONTAGNE (diameter of the particles 2–3 μm), the dimethylformamide being replaced weight by weight by dimethyl acetamide:

In connection with the adherence test, the result corresponds to the mark ¾.

The resistance against the neutral salt spray is higher than 600 hours.

EXAMPLE 4

A bath identical to that of example 1 is prepared, using zinc powder identical to that of example 2 and replacing weight by weight the dimethylformamide by N-methyl pyrrolidone.

In connection with the adherence test, the result corresponds to the mark ¾.

The resistance against the neutral salt spray is higher than 800 hours.

EXAMPLE 5

A solution A consisting of 150 g of zinc powder (quality ULTRA FINE SPECIALE commercialized by the Company VIEILLE MONTAGNE), 30 g of nonylphenol having 10 moles of ethylene oxide (CEMULSOL NP 10 commercialized by RHONE-POULENC), 60 g of cyclohexanone and 2 g of hydroxymethyl cellulose is prepared.

A solution B consists of 27.6 g of chromic acid, of 17.4 g of magnesium chromate and of 298 g of water.

A solution C is identical to that disclosed in example 1. The mixture of the three solutions gives 1170 g of a bath ready to be used.

In connection with the adherence test, the result corresponds to the mark 4/5.

The resistance against the salt spray is higher than 600 hours.

EXAMPLE 6

A bath identical to that of example 1 in which a part of the lamellar zinc (i.e. 30 g) is replaced by lamellar aluminum (30 g) is prepared. The lamellar aluminum is that which is commercialized under the trademark CHROMAL II by the Company ECKARTWERKE and its particle size is comparable to that of the zinc (about 18 μm along its greater length).

A coating is produced on screw-cutting by way of two applications as disclosed hereabove with an intermediate curing at 180° C.

The adherence cannot be measured by the method disclosed in example 1, as no stamp can be obtained.

The resistance against the salt spray is higher than 500 hours.

We claim:

1. Hexavalent chromium containing coating bath for metallic substrates comprising:

a metal in the form of particles an oxidizing agent selected from the group consisting of chromic acid and of its derivatives at least one hydrosoluble aprotic polar solvent selected from the group consisting of those represented by the formula (II)

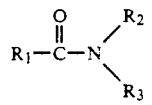

(II)

in which the radicals $R_1$, $R_2$ and $R_3$ represent linear or ramified alkyl groups in $C_1$ to $C_{18}$, identical or different from one another, and suitable to form a cycle, and water.

2. Hexavalent chromium containing coating bath for metallic substrates comprising:

a metal in the form of particles an oxidizing agent selected from the group consisting of chromic acid and of its derivatives at least one hydrosoluble ketonic solvent selected from the group consisting of polyketonic derivatives, lactones and of those represented by the formula (I)

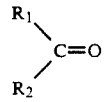

(I)

in which the radicals $R_1$ and $R_2$ represent linear or ramified alkyl groups in $C_1$ to $C_{18}$, identical or different from one another, and suitable to form a cycle, with the proviso that their solubility in water is at least equal to 5% (W/W), their flash point is higher than or equal to 50° C. and their boiling point is at least equal to 100° C., and water.

3. Bath according to claim 1, wherein the hydrosoluble solvent is present in an amount such that the mass ratio solvent/chromate ion is comprised between 0.5 and 20.

4. Bath according to claim 2, wherein the hydrosoluble solvent is present in an amount such that the mass ratio solvent/chromate ion is comprised between 0.5 and 20.

5. Bath according to claim 1, wherein the hydrosoluble solvent is selected from the group consisting of dimethyl formamide and dimethyl acetamide.

6. Bath according to claim 2, wherein the hydrosoluble solvent is selected from the group consisting of cyclohexanone, hexane-dione-2,5, gama-butyrolactone and N-methyl-2-pyrrolidone.

7. Process for providing on a metallic substrate a protective coating against corrosion based on hexavalent chromium, without any necessity of a supplementary protection, the said process comprising:

subjecting the metallic substrate to at least the first step of the group of three steps consisting of degreasing, mechanical pickling and chemical pickling, treating the metallic substrate with a bath according to claim 1, and curing the thus treated metallic substrate at high temperature.

8. Process for providing on a metallic substrate a protective coating against corrosion based on hexavalent chromium, without any necessity of a supplementary protection, the said process comprising:

subjecting the metallic substrate to at least the first step of the group of three steps consisting of degreasing, mechanical pickling and chemical pickling, treating the metallic substrate with a bath according to claim 2, and curing the thus treated metallic substrate at high temperature.

* * * * *